US006619773B2

(12) United States Patent
Amsterdam

(10) Patent No.: US 6,619,773 B2
(45) Date of Patent: Sep. 16, 2003

(54) HANGING VERTICAL ORGANIZER FOR FILE DRAWER

(76) Inventor: Donna B. Amsterdam, 51 Country Club Rd., Tenafly, NJ (US) 07670

( * ) Notice: Subject to any disclaimer, the term of this patent is extended or adjusted under 35 U.S.C. 154(b) by 0 days.

(21) Appl. No.: 09/871,359

(22) Filed: May 31, 2001

(65) Prior Publication Data

US 2002/0180320 A1 Dec. 5, 2002

(51) Int. Cl.[7] ..... A47B 88/00

(52) U.S. Cl. ..... 312/348.3; 312/348.5; 229/67.2

(58) Field of Search ..... 312/348.5, 348.3, 312/291, 299, 301, 184; 206/425; 220/527, 528, 534, 543, 544, 549, 23.87; 229/67.2

(56) References Cited

U.S. PATENT DOCUMENTS

| | | | | | |
|---|---|---|---|---|---|
| 2,076,173 | A | * | 4/1937 | Cocks | 312/299 |
| 4,867,319 | A | * | 9/1989 | Arner et al. | 229/67.2 |
| 4,993,786 | A | * | 2/1991 | De Giulio | 312/301 |
| 5,025,979 | A | * | 6/1991 | Dellacroce | 229/67.2 |
| 5,219,216 | A | * | 6/1993 | Hassel et al. | 312/183 |
| 5,385,230 | A | * | 1/1995 | Nygard et al. | 206/214 |
| 5,462,348 | A | * | 10/1995 | Ellingson et al. | 312/301 |
| 5,738,425 | A | * | 4/1998 | Rosenberg et al. | 312/348.3 |
| 5,813,734 | A | * | 9/1998 | Ong | 312/184 |
| 5,927,839 | A | * | 7/1999 | Alfaro | 312/291 |
| 5,971,166 | A | * | 10/1999 | Ong | 312/184 |
| 6,039,473 | A | * | 3/2000 | Bond | 229/67.2 |
| 6,273,470 | B1 | * | 8/2001 | Bullock | 229/67.2 |

FOREIGN PATENT DOCUMENTS

| | | | | |
|---|---|---|---|---|
| DE | 3901331 | * | 7/1990 | 312/348.3 |
| FR | 2652249 | * | 3/1991 | 312/348.3 |
| GB | 2167389 | * | 5/1986 | |

* cited by examiner

*Primary Examiner*—Lanna Mai
*Assistant Examiner*—Hanh V. Tran
(74) *Attorney, Agent, or Firm*—Abelman, Frayne & Schwab

(57) ABSTRACT

A rigid rectangular container has front and back walls and a pair of side walls extending upwardly from a bottom wall. Hooks extend away from the top corners of the front and back walls to engage conventional hanging rails installed in desks and filing cabinets. The container further includes partitioning dividers extending to the bottom wall to divide the internal space of the container into vertically oriented compartments. The vertical dimension of the dividers can be less than the vertical dimension of the side walls to provide a space above the dividers to slidably receive a rectangular tray having hooks at the corners that extend away from each top corner of the tray to engage the side walls of the container.

5 Claims, 2 Drawing Sheets

HANGING VERTICAL ORGANIZER FOR FILE DRAWER

BACKGROUND OF INVENTION

This invention relates to a hanging container for storing articles in vertically oriented compartments. This invention further includes a separate hanging shallow tray placed over a portion of the hanging container and supported by hangers cooperating with side walls of the hanging container.

Hanging organizers are known. See, for example, U.S. Pat. No. 5,219,216 to Hassel, et al., and U.S. Pat. No. 5,385,230 to Nygard, et al. Both of these patents show organizers supported by a lip extending from a side wall of the organizer for cooperating with a hanging rail conventionally located inside a desk drawer or file cabinet. In particular, the Hassel patent shows an organizer for holding diskettes in a vertically oriented position between divider channels, and the Nygard patent shows a hanging tray assembly having preformed wall dividers defining a plurality of receptacles.

A need exists for a hanging organizer supported between the hanging rails conventionally located inside a desk drawer or file cabinet which allows for vertical storage of scissors, pens, pencils, staplers and the like. Further, a need exists for a hanging organizer which is supported adjacent the top opening of the drawer or file cabinet to facilitate easy access to the contents of the organizer.

A further need exists for a vertical organizer which can be moved to the front or the rear of the drawer to accommodate files and other materials that may be placed in the drawer.

A further need exists for a vertical organizer which is suspended above the bottom of the drawer to allow papers, books and other articles to be laid flat beneath the organizer and yet provide access to these materials by merely sliding the organizer to an alternate position.

A further need exists for a vertical organizer which allows a manufacturer to produce a container of a single depth that does not take into account drawers of varying depths.

A further need exists for a separate hanging shallow tray which may be placed over a portion of the vertical organizer and supported by hangers cooperating with side walls of the organizer to provide easy access to the tray which tray may be used for holding paper clips, rubber bands, tape and the like.

A need also exists for a vertical organizer that is lightweight and inexpensive to manufacture in various widths, length and depths to meet the needs of user.

SUMMARY OF INVENTION

The present invention is directed to a rectangular container having front and back walls and a pair of side walls extending upwardly from a bottom wall. Hooks extend away from the top corners of the front and back walls which hooks are used to engage conventional hanging rails found in various desks and file cabinets. The container further includes partitioning dividers resting on the bottom wall to divide the internal space of the container into vertically oriented compartments. The vertical dimension of the dividers is selected to be less than the vertical dimension of the side walls to provide a space within the container above the dividers. A rectangular tray is provided for positioning within the space. The tray includes hooks at the corners that extend away from each top corner of the tray to engage the side walls of the container.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
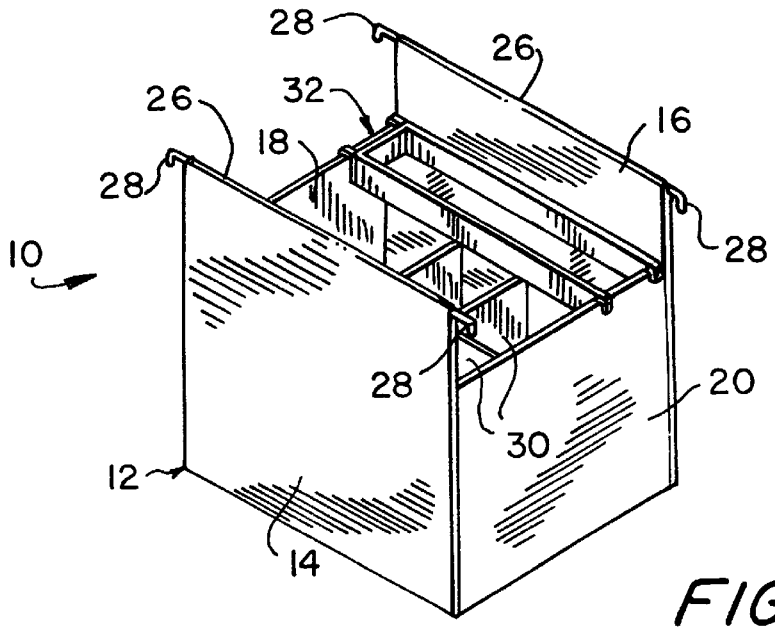
FIG. 1 is a perspective view of a vertical organizer for a file drawer according to the present invention with a separate tray installed.

A preferred embodiment of the vertical organizer 10 for a file drawer is shown in FIG. 1. Vertical organizer 10 includes an open-top rectangular container 12 having a front wall 14 and a parallel, spaced-apart back wall 16, and also a left side wall 18 and a parallel, spaced-apart right side wall 20. In addition, container 12 has a bottom wall 22 underlying all four walls 14, 16, 18 and 20.

The side walls 18 and 20 are similarly sized and shaped. The front and back walls 14 and 16 are similarly sized and shaped, but each includes a vertical dimension longer than the side walls 18 and 20 as shown in FIG. 1. At each of the top corners of front wall 14 and rear wall 16, a hanger hook 28 is provided. Hanger hooks 28 face downwardly toward bottom wall 22 for engaging a pair of parallel spaced-apart hanging rails conventionally found in desk drawers and file cabinets to support the vertical organizer 10 above the bottom wall of the drawer or file cabinet with which the present invention is used.

Hanger hooks 28 may be formed in front wall 14 and rear wall 16 during the manufacturing process or may be connected to a pair of rods, each of which is threaded through an opening formed along a respective top edge of front wall 14 and rear wall 16. Further, hooks 28 may be separately glued or stapled to the front and rear walls, or attached by any other of the methods used by those skilled in the art to attach such hooks to a plane surface.

Figure 2:
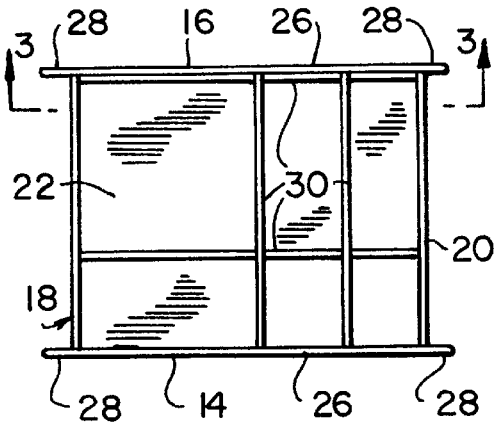
FIG. 2 is a plan view of the vertical organizer shown in FIG. 1 with the tray removed.
Figure 3:
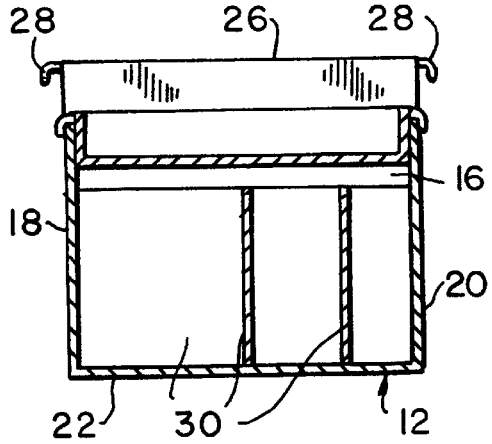
FIG. 3 is a cross-sectional view of the vertical organizer for a file drawer taken along the line 3—3 in FIG. 2 with the tray installed as shown in FIG. 1.

In a preferred embodiment, a plurality of dividers 30, best seen in FIG. 2, are provided for internally dividing the interior of the vertical organizer 10 into vertical compartments. Dividers 30 rest upon bottom wall 22 and extend upwardly substantially perpendicular to the bottom wall 22. Dividers 30 may be constructed with mating slots (not shown) so that a slot of a first divider can be inserted into an opposite facing slot of a second divider positioned approximately perpendicular to the first divider to form four compartments in a conventional manner. This technique forcefully holds the two dividers in place. Multiple slots of the dividers may be appropriately placed intermediate the two ends of each divider to provide different size compartments between the dividers. This permits a user to alter the size and spacing of the storage compartments in the container. This conventional manner of joining perpendicular dividers is well known to those skilled in the art, although other means of accomplishing the same function could be used equally as well as the one just described. The compartments formed by the perpendicular dividers 30 will hold many common objects in a vertical, organized way.

In a preferred embodiment, the walls of container 12, as well as dividers 30, are made of corrugated plastic board, although other stiff materials such as sheet and molded plastic, cardboard, corrugated paperboard metal, fiberglass, or wood could be used equally as well.

The organizer has dimensions that are, in part, determined by the space between the supporting rails in existing filing cabinets and desk drawers that define the width, i.e., to accommodate standard or legal size files. The depth and length can be varied to suit the needs and intended uses of the organizer.

Figure 4:
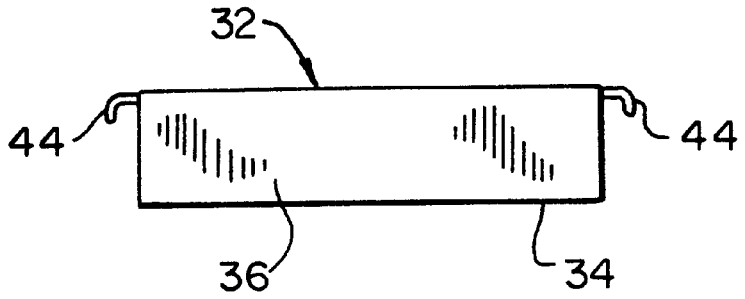
FIG. 4 is an elevational view of the tray shown in FIG. 1.
Figure 5:
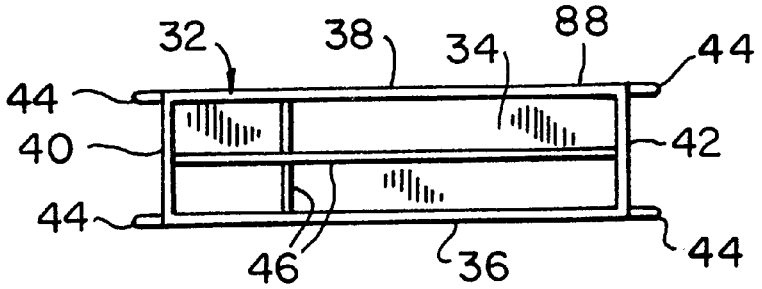
FIG. 5 is a plan view of the tray shown in FIG. 4.
Figure 6:
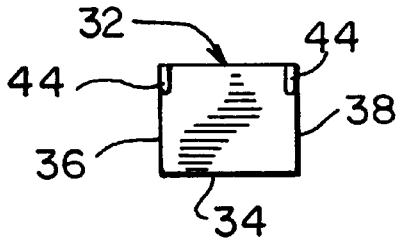
FIG. 6 is a left-hand end view of the tray shown in FIG. 4.

A separate rectangular shallow tray 32 may also be used with the vertical organizer 10. Shallow tray 32 has an open top and includes a bottom wall 34, a front wall 36, back wall 38, left side wall 40 and right side wall 42. Tray hooks 44 extend outwardly from the top corners of front wall 36 and back wall 34, as shown in FIGS. 4–6. The front wall 36 and back wall 38 are sized laterally so that hooks 44 may engage the side walls 18 and 20 as shown in FIG. 1 to suspend tray 32 from the side walls 18 and 20. When using tray 32, the dividers 30 must have a vertical dimension shorter than the vertical dimension of side walls 18 and 20 to provide a space above dividers 30 to receive the tray 32, as shown in FIG. 1.

Hooks 44 may be installed on the front wall 36 and back wall 38 using any of the techniques described above with respect to hooks 28.

Tray 32 may also be provided with dividers 46 as shown in FIG. 5 which have a construction similar to that of dividers 30 described above.

Figure 7:
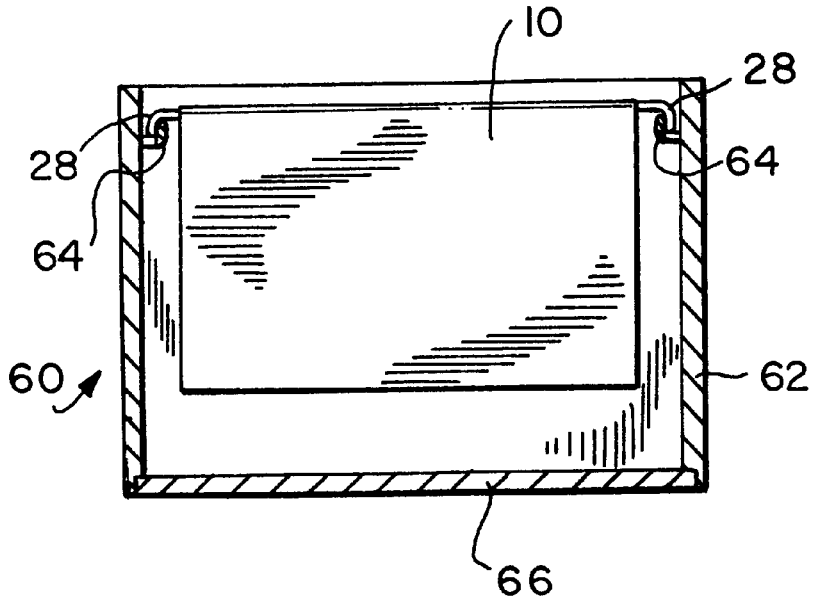
FIG. 7 is an elevational view partly in section, showing the organizer positioned in a desk drawer.

As shown in FIG. 7, the present invention provides a vertical organizer which can be suspended from the conventional hanging rails 64 found in various desks, drawers and file cabinets. With the hooks 28 resting on the rails 64 secured to the side walls 62 of drawer 60, the vertical organizer 10 can be moved along the rails to any position so that files or other materials can be placed on either side of the vertical organizer, or underneath the vertical organizer on drawer bottom 66, and yet the organizer providing appropriate compartments for vertical storage of scissors, pens, pencils, staplers and the like. As described above, a shallow tray 32 for receiving paper clips, rubber bands and other small items is conveniently placed over a portion of the vertical organizer 10 and supported by hangers cooperating with the side walls of the organizer to provide easy access to the tray holding various smaller items.

The hanging vertical organizer 10 may be moved along the rails 64 of the hanging rack to any desired position, and the hanging tray 32 may be moved along the top edges of side walls 18 and 20 to any desired position.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. A vertical organizer to be suspended from a pair of parallel, spaced-apart hanging rails provided in a desk drawer or file cabinet, the organizer comprising:

an open-top, rectangular container body having a front wall, a rear wall, and a pair of parallel, spaced-apart planar rigid side walls, and a bottom wall underlying the front, rear and side walls;

a pair of hooks, each positioned at an upper corner of the front wall, the hooks extending outwardly from the front wall in a plane parallel to the front wall;

a pair of hooks, each positioned at an upper corner of the rear wall, the hooks extending outwardly from the rear wall in a plane parallel to the rear wall; and dividers inter-fisted within the container body for vertically dividing the container body into a plurality of compartments;

wherein the front wall and rear wall are sized to enable the hooks on one side of the body to rest on one of the hanging rails and the hooks on the opposite side of the body to rest on the other hanging rail; and wherein the vertical dimension of the dividers is shorter than the vertical dimension of the side walls for providing a space within the container body above the dividers and a top edge of the side walls, and further including a tray positioned in the space above the dividers.

2. The vertical organizer according to claim 1 wherein the container body is constructed of plastic, corrugated cardboard, fiberglass, metal or wood.

3. The vertical organizer according to claim 1 wherein the tray has a rectangular shape and comprises:

a front wall, a rear wall and a pair of parallel, spaced-apart side walls and a bottom wall underlying the front, rear and side walls;

a pair of hooks each positioned at an upper corner of the front wall, the hooks extending outwardly from the front wall in a plane parallel to the front wall;

a pair of hooks each positioned at an upper corner of the rear wall, the hooks extending outwardly from the rear wall in a plane parallel to the rear wall; and the front wall and rear wall sized to enable the hooks on one side of the body to rest on one of the side walls of the container body and the hooks on the opposite side of the tray to rest on the other side wall of the container.

4. A vertical organize to be suspended from a pair of parallel, spaced-apart hanging rails provided in a desk drawer or file cabinet comprising:

an open-top, rectangular container body having a front wall, a rear wall, and a pair of parallel, spaced-apart side walls, and a bottom wall underlying the front, rear and side walls;

a pair of hooks each positioned at an upper corner of the front wall, the hooks extending outwardly from the front wall in a plane parallel to the front wall;

a pair of hooks each positioned at an upper corner of the rear wall, the hooks extending outwardly from the rear wall in a plane parallel to the rear wall, wherein the front wall and rear wall sized to enable the hooks on one side of the body to rest on one of the hanging tails, and to enable the hooks on the opposite side of the body to rest on the other hanging rail; and dividers inter-fitted within the container body for vertically dividing the container body into a plurality of compartments;

wherein the front and rear walls have a similar size and shape and the side walls have a similar size and shape, and further wherein the side walls have a vertical dimension shorter than the front and rear walls, and further wherein the vertical dimension of the dividers is shorter than the vertical dimension of the side walls for providing a space within the container body above the dividers and a top edge of the side walls, and further including a tray positioned in the space above the dividers.

5. The vertical organizer according to claim 4 wherein the tray has a rectangular shape and comprises:

a front wall, a rear wall and a pair of parallel, spaced-apart side walls and a bottom wall underlying the front, rear and side walls;

a pair of hooks each positioned at an upper corner of the front wall, the hooks extending outwardly from the front wall in a plane parallel to the front wall;

a pair of hooks each positioned at an upper corner of the rear wall, the hooks extending outwardly from the rear wall in a plane parallel to the rear wall; and the front wall and rear wall sized to enable the hooks on one side of the body to rest on one of the side walls of the container body, and to enable the hooks on the opposite side of the tray to rest on the other side wall of the container body.

* * * * *